US011056034B2

(12) United States Patent
Xiao

(10) Patent No.: US 11,056,034 B2
(45) Date of Patent: Jul. 6, 2021

(54) ELECTROSTATIC PROTECTION DEVICE AND DISPLAY PANEL

(71) Applicant: Shenzhen China Star Optoelectronics Semiconductor Display Technology Co., Ltd., Shenzhen (CN)

(72) Inventor: Xiang Xiao, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 99 days.

(21) Appl. No.: 16/611,222

(22) PCT Filed: Aug. 6, 2019

(86) PCT No.: PCT/CN2019/099482
§ 371 (c)(1),
(2) Date: Nov. 6, 2019

(87) PCT Pub. No.: WO2020/224074
PCT Pub. Date: Nov. 12, 2020

(65) Prior Publication Data

US 2020/0349877 A1 Nov. 5, 2020

(30) Foreign Application Priority Data

May 5, 2019 (CN) ..... 201910369068.X

(51) Int. Cl.
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2330/04* (2013.01); *G09G 2330/08* (2013.01)

(58) Field of Classification Search
CPC ..... G06F 2203/04107; G09G 2330/04; G09G 2330/08
See application file for complete search history.

(56) References Cited

U.S. PATENT DOCUMENTS

2015/0091018 A1 4/2015 Kobashi
2019/0272057 A1* 9/2019 Chen ..... G06F 3/0416
2020/0144247 A1* 5/2020 Long ..... H01L 27/0266

FOREIGN PATENT DOCUMENTS

CN 105676512 6/2016
CN 101728395 10/2020

* cited by examiner

*Primary Examiner* — Gerald Johnson

(57) ABSTRACT

An embodiment of the present invention discloses an electrostatic protection device and a display panel. The electrostatic protection device includes a first electric discharge circuit and a second electric discharge circuit. An input terminal of the first electric discharge circuit is connected to a display circuit of the display panel. An output terminal of the first electric discharge circuit is connected to an electrostatic discharge line. An input terminal of the second electric discharge circuit is connected to an external signal input terminal of the display circuit. An output terminal of the second electric discharge circuit is connected to the electrostatic discharge line. The present invention can prevent damages of the display panel.

20 Claims, 3 Drawing Sheets

ELECTROSTATIC PROTECTION DEVICE AND DISPLAY PANEL

RELATED APPLICATIONS

This application is a National Phase of PCT Patent Application No. PCT/CN2019/099482 having International filing date of Aug. 6, 2019, which claims the benefit of priority of Chinese Patent Application No. 201910369068.X filed on May 5, 2019. The contents of the above applications are all incorporated by reference as if fully set forth herein in their entirety.

FIELD AND BACKGROUND OF THE INVENTION

The present invention relates to a field of display technologies, specifically to an electrostatic protection device and a display panel.

During manufacturing and use testing of a display panel, because of some external factors, static electricity is usually accumulated in the display panel. When static electricity charges are accumulated for a certain amount, electrostatic discharge (ESD) occurs.

electrostatic discharge happens in a very short time, a large amount of charges are transferred in a very short time and generate an extremely high current which strikes through a semiconductor device, or generates sufficient heat to melt the semiconductor device. Such hazard usually causes degradation or scrapping of some of the components or devices without being noticeable, which deliver huge economic loss. Therefore, electrostatic discharge brings fatal harm to electronic products, which only lowers reliability of a product but also increases cost of maintenance. Every year electrostatic discharge brings loss of billions of dollars to electrical manufacturing industries.

Although the conventional display panel disposes a static electricity-proof unit, the unit only aims for discharging static electricity in the display circuit in the display panel and cannot prevent static electricity entering from an external into an internal of the display circuit such that the static electricity damages the display circuit.

In other words, in the conventional technology, static electricity easily enters the display circuit to damage the display panel.

SUMMARY OF THE INVENTION

Technical Solution

In other words, in the conventional technology, static electricity easily enters the display circuit to damage the display panel.

Technical Solution

An embodiment of the present invention provides an electrostatic protection device and a display panel that are able to discharge static electricity in a display circuit and prevent external static electricity from entering an internal of the display circuit such that damage to the display panel is avoided.

To solve the above issue, in a first aspect, the present invention provides an electrostatic protection device, the electrostatic protection device comprises a first electric discharge circuit and a second electric discharge circuit;

an input terminal of the first electric discharge circuit is connected to a display circuit of a display panel, an output terminal of the first electric discharge circuit is connected to an electrostatic discharge line, the first electric discharge circuit is configured to discharge static electricity to the electrostatic discharge line when the display circuit of the display panel generates static electricity, wherein the display circuit is located in a display region of the display panel;

the first electric discharge circuit is one of a resistor-type electric discharge circuit, a floating-gate-type electric discharge circuit, and a diode-type electric discharge circuit, the input terminal of the first electric discharge circuit is connected to a scan line or a data line in the display circuit to discharge static electricity generated from the scan line or the data line, an external signal input terminal is located on an end portion of the scan line or the data line to input a scan signal or a data signal into the scan line or the data line; and an input terminal of the second electric discharge circuit is connected to the external signal input terminal of the display circuit, the external signal input terminal is configured to input a signal into the display circuit, an output terminal of the second electric discharge circuit is connected to the electrostatic discharge line, the second electric discharge circuit discharges static electricity into the electrostatic discharge line when the external signal input terminal generates static electricity to prevent static electricity generated on the external signal input terminal from entering the display circuit.

The second electric discharge circuit comprises a first transistor and a second transistor, a gate electrode and a drain electrode of the first transistor are connected to the external signal input terminal, a source electrode of the first transistor is connected to the electrostatic discharge line, the first transistor is switched on when a voltage difference between the gate electrode of the first transistor and the source electrode of the first transistor exceeds a first predetermined threshold value to discharge to discharge positive charges on the external signal input terminal; and a gate electrode and a drain electrode of the second transistor are connected to the electrostatic discharge line, a source electrode of the second transistor is connected to the external signal input terminal, the second transistor is switched on when a voltage difference between the gate electrode of the second transistor and an output terminal of the second transistor exceeds a second predetermined threshold value to discharge negative charges on the external signal input terminal.

The second electric discharge circuit further comprises a voltage delay unit and a third transistor;

the source electrode of the first transistor, a first end of the voltage delay unit, and a source electrode of the third transistor are connected, the first transistor is connected to the electrostatic discharge line by the voltage delay unit and the third transistor and is further switched on when static electricity is generated to discharge static electricity to the electrostatic discharge line by the voltage delay unit and the third transistor;

a gate electrode of the third transistor is connected to a second end of the voltage delay unit, a drain electrode of the third transistor is connected to the electrostatic discharge line; and a third end of the voltage delay unit is connected to the electrostatic discharge line, the voltage delay unit eases an increasing amount of voltage of the gate electrode of the third transistor at a moment when static electricity is generated to generate a voltage difference between the gate electrode and the source electrode of the third transistor such that the third transistor is switched on and the third transistor discharges the static electricity to the electrostatic discharge line.

The voltage delay unit comprises a resistor and a capacitor that are sequentially connected to the voltage delay unit, an end of the resistor, an end of the capacitor, and the gate electrode of the third transistor are connected, another end of the resistor is connected to the source electrode of the third transistor, and another end of the capacitor is connected to the electrostatic discharge line.

The source electrode of the first transistor, the first end of the voltage delay unit, and the source electrode of the third transistor are connected to a working voltage line, the working voltage line outputs a working voltage when the display panel operates to switch off the first transistor and the third transistor.

The second electric discharge circuit further comprises a fourth transistor and a fifth transistor;

a gate electrode of the fourth transistor is connected to the second end of the voltage delay unit, a source electrode of the fourth transistor is connected to the electrostatic discharge line, the drain electrode of the third transistor is connected to a drain electrode of the fourth transistor to be connected to the electrostatic discharge line through the fourth transistor; and a gate electrode of the fifth transistor is connected to the drain electrode of the third transistor, a source electrode of the fifth transistor is connected to the electrostatic discharge line, a drain electrode of the fifth transistor is connected to the source electrode of the third transistor, the fifth transistor is switched on when the third transistor is switched on to discharge the static electricity to the electrostatic discharge line.

The first transistor is an N-type transistor, the second transistor is a P-type transistor, the third transistor is a P-type transistor, the fourth transistor is an N-type transistor, and the fifth transistor is an N-type transistor.

To solve the above issue, in a second aspect, the present invention provides an electrostatic protection device, the electrostatic protection device comprises a first electric discharge circuit and a second electric discharge circuit;

the input terminal of the first electric discharge circuit is connected to the display circuit of the display panel, the output terminal of the first electric discharge circuit is connected to the electrostatic discharge line, the first electric discharge circuit is configured to discharge static electricity to the electrostatic discharge line when the display circuit of the display panel generates static electricity, wherein the display circuit is located in the display region of the display panel; and the input terminal of the second electric discharge circuit is connected to the external signal input terminal of the display circuit, the external signal input terminal is configured to input a signal into the display circuit, the output terminal of the second electric discharge circuit is connected to the electrostatic discharge line, the second electric discharge circuit discharge static electricity to the electrostatic discharge line when the external signal input terminal generates static electricity to prevent the static electricity generated on the external signal input terminal from entering the display circuit.

The second electric discharge circuit comprises a first transistor and a second transistor, a gate electrode and a drain electrode of the first transistor are connected to the external signal input terminal, a source electrode of the first transistor is connected to the electrostatic discharge line, the first transistor is switched on when a voltage difference between the gate electrode of the first transistor and the source electrode of the first transistor exceeds a first predetermined threshold value to discharge to discharge positive charges on the external signal input terminal; and a gate electrode and a drain electrode of the second transistor are connected to the electrostatic discharge line, a source electrode of the second transistor is connected to the external signal input terminal, the second transistor is switched on when a voltage difference between the gate electrode of the second transistor and an output terminal of the second transistor exceeds a second predetermined threshold value to discharge negative charges on the external signal input terminal.

The second electric discharge circuit further comprises a voltage delay unit and a third transistor;

the source electrode of the first transistor, a first end of the voltage delay unit, and a source electrode of the third transistor are connected, the first transistor is connected to the electrostatic discharge line by the voltage delay unit and the third transistor and is further switched on when static electricity is generated to discharge static electricity to the electrostatic discharge line by the voltage delay unit and the third transistor;

a gate electrode of the third transistor is connected to a second end of the voltage delay unit, a drain electrode of the third transistor is connected to the electrostatic discharge line; and a third end of the voltage delay unit is connected to the electrostatic discharge line, the voltage delay unit eases an increasing amount of voltage of the gate electrode of the third transistor at a moment when static electricity is generated to generate a voltage difference between the gate electrode and the source electrode of the third transistor such that the third transistor is switched on and the third transistor discharges the static electricity to the electrostatic discharge line.

The voltage delay unit comprises a resistor and a capacitor that are sequentially connected to the voltage delay unit, an end of the resistor, an end of the capacitor, and the gate electrode of the third transistor are connected, another end of the resistor is connected to the source electrode of the third transistor, and another end of the capacitor is connected to the electrostatic discharge line.

The source electrode of the first transistor, the first end of the voltage delay unit, and the source electrode of the third transistor are connected to a working voltage line, the working voltage line outputs a working voltage when the display panel operates to switch off the first transistor and the third transistor.

the second electric discharge circuit further comprises a fourth transistor and a fifth transistor;

a gate electrode of the fourth transistor is connected to the second end of the voltage delay unit, a source electrode of the fourth transistor is connected to the electrostatic discharge line, the drain electrode of the third transistor is connected to a drain electrode of the fourth transistor to be connected to the electrostatic discharge line through the fourth transistor; and a gate electrode of the fifth transistor is connected to the drain electrode of the third transistor, a source electrode of the fifth transistor is connected to the electrostatic discharge line, a drain electrode of the fifth transistor is connected to the source electrode of the third transistor, the fifth transistor is switched on when the third transistor is switched on to discharge the static electricity to the electrostatic discharge line.

The first transistor is an N-type transistor, the second transistor is a P-type transistor, the third transistor is a P-type transistor, the fourth transistor is an N-type transistor, and the fifth transistor is an N-type transistor.

The first electric discharge circuit is one of a resistor-type electric discharge circuit, a floating-gate-type electric discharge circuit, and a diode-type electric discharge circuit.

The input terminal of the first electric discharge circuit is connected to a scan line or a data line in the display circuit to discharge static electricity generated from the scan line or the data line, an external signal input terminal is located on an end portion of the scan line or the data line to input a scan signal or a data signal into the scan line or the data line.

To solve the above issue, in a third aspect, the present invention provides a display panel, the display panel comprises an electrostatic protection device, the electrostatic protection device comprises a first electric discharge circuit and a second electric discharge circuit;

the input terminal of the first electric discharge circuit is connected to the display circuit of the display panel, the output terminal of the first electric discharge circuit is connected to the electrostatic discharge line, the first electric discharge circuit is configured to discharge static electricity to the electrostatic discharge line when the display circuit of the display panel generates static electricity, wherein the display circuit is located in the display region of the display panel; and the input terminal of the second electric discharge circuit is connected to the external signal input terminal of the display circuit, the external signal input terminal is configured to input a signal into the display circuit, the output terminal of the second electric discharge circuit is connected to the electrostatic discharge line, the second electric discharge circuit discharge static electricity to the electrostatic discharge line when the external signal input terminal generates static electricity to prevent the static electricity generated on the external signal input terminal from entering the display circuit.

The second electric discharge circuit comprises a first transistor and a second transistor, a gate electrode and a drain electrode of the first transistor are connected to the external signal input terminal, a source electrode of the first transistor is connected to the electrostatic discharge line, the first transistor is switched on when a voltage difference between the gate electrode of the first transistor and the source electrode of the first transistor exceeds a first predetermined threshold value to discharge to discharge positive charges on the external signal input terminal; and a gate electrode and a drain electrode of the second transistor are connected to the electrostatic discharge line, a source electrode of the second transistor is connected to the external signal input terminal, the second transistor is switched on when a voltage difference between the gate electrode of the second transistor and an output terminal of the second transistor exceeds a second predetermined threshold value to discharge negative charges on the external signal input terminal.

The second electric discharge circuit further comprises a voltage delay unit and a third transistor;

the source electrode of the first transistor, a first end of the voltage delay unit, and a source electrode of the third transistor are connected, the first transistor is connected to the electrostatic discharge line by the voltage delay unit and the third transistor and is further switched on when static electricity is generated to discharge static electricity to the electrostatic discharge line by the voltage delay unit and the third transistor;

a gate electrode of the third transistor is connected to a second end of the voltage delay unit, a drain electrode of the third transistor is connected to the electrostatic discharge line; and a third end of the voltage delay unit is connected to the electrostatic discharge line, the voltage delay unit eases an increasing amount of voltage of the gate electrode of the third transistor at a moment when static electricity is generated to generate a voltage difference between the gate electrode and the source electrode of the third transistor such that the third transistor is switched on and the third transistor discharges the static electricity to the electrostatic discharge line.

The voltage delay unit comprises a resistor and a capacitor that are sequentially connected to the voltage delay unit, an end of the resistor, an end of the capacitor, and the gate electrode of the third transistor are connected, another end of the resistor is connected to the source electrode of the third transistor, and another end of the capacitor is connected to the electrostatic discharge line.

Advantages

Advantages: Compared to the prior art, the present invention provides an electrostatic protection device and a display panel. The electrostatic protection device comprises a first electric discharge circuit and a second electric discharge circuit. An input terminal of the first electric discharge circuit is connected to a display circuit of the display panel. An output terminal of the first electric discharge circuit is connected to an electrostatic discharge line. The first electric discharge circuit is configured to discharge static electricity to the electrostatic discharge line when the display circuit of the display panel generates static electricity, and the display circuit is located in a display region of the display panel. An input terminal of the second electric discharge circuit is connected to an external signal input terminal of the display circuit, and the external signal input terminal is configured to input signals to the display circuit. An output terminal of the second electric discharge circuit is connected to the electrostatic discharge line, and the second electric discharge circuit discharges static electricity to the electrostatic discharge line when the external signal input terminal generates static electricity to prevent the static electricity generated on the external signal input terminal from entering the display circuit. The present invention, by the first electric discharge circuit discharging the static electricity in the display panel and by the second electric discharge circuit directly discharging external static electricity, discharges the static electricity in the display circuit and prevents the external static electricity from entering the display circuit and damaging the display panel.

BRIEF DESCRIPTION OF THE SEVERAL VIEWS OF THE DRAWINGS

To more clearly elaborate on the technical solutions of embodiments of the present invention or prior art, appended figures necessary for describing the embodiments of the present invention or prior art will be briefly introduced as follows. Apparently, the following appended figures are merely some embodiments of the present invention. A person of ordinary skill in the art may acquire other figures according to the appended figures without any creative effort.

DESCRIPTION OF SPECIFIC EMBODIMENTS OF THE INVENTION

Figure 1:
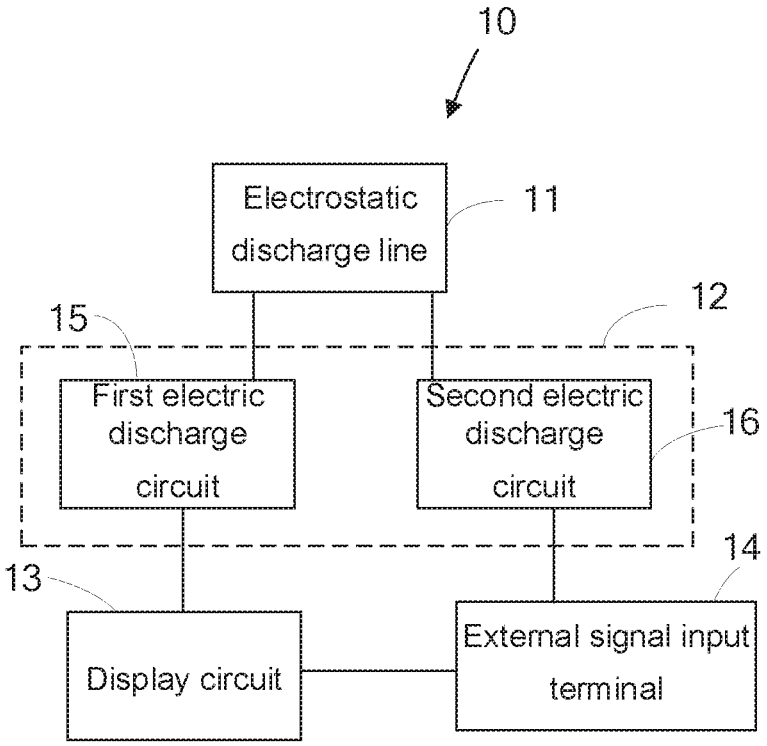
FIG. 1 is a schematic structural view of a display panel provided by an embodiment of the present invention.

The technical solution in the embodiment of the present invention will be clearly and completely described below with reference to the accompanying drawings in the embodiments of the present invention. Apparently, the described embodiments are merely some embodiments of the present invention instead of all embodiments. According to the embodiments in the present invention, all other embodiments obtained by those skilled in the art without making any creative effort shall fall within the protection scope of the present invention.

In the description of the present invention, it should be understood that terminologies "center", "longitudinal", "transverse", "length", "width", "thickness", "upper", "lower", "front", "rear", "left", "side", "vertical", "horizontal", "top", "bottom", "inner", "outer", "clockwise", "counterclockwise" for indicating relations of orientation or position are based on orientation or position of the accompanying drawings, are only for the purposes of facilitating description of the present invention and simplifying the description instead of indicating or implying that the referred device or element must have a specific orientation or position, must to be structured and operated with the specific orientation or position. Therefore, they should not be understood as limitations to the present invention. Furthermore, terminologies "first", "second" are only for the purposes of description, and cannot be understood as indication or implication of comparative importance or a number of technical features. Therefore, a feature limited with "first", "second" can expressly or implicitly include one or more features. In the description of the present invention, a meaning of "a plurality of" is two or more, unless there is a clear and specific limitation otherwise.

In the present invention, the word "exemplary" is used to mean "serving as an example, illustration or description". Any embodiment described as "exemplary" in the present invention is not necessarily construed as preferred or more advantageous over other embodiments. In order to enable any person skilled in the art to implement and use the present invention, the following description is given. In the following description, details are set forth for the purpose of explanation. It should be understood that a person of ordinary skill in the art will appreciate that the present invention may be implemented without the use of these specific details. In other instances, the known structures and processes are not elaborated to avoid unnecessary details from making descriptions of the present invention becomes ambiguous. Therefore, the present invention is not intended to be limited to the illustrated embodiment, but is consistent with the broadest scope of the principles and features disclosed by the present invention.

An embodiment of the present invention provides an electrostatic protection device, and the electrostatic protection device comprises a first electric discharge circuit and a second electric discharge circuit. An input terminal of the first electric discharge circuit is connected to a display circuit of the display panel. An output terminal of the first electric discharge circuit is connected to an electrostatic discharge line. The first electric discharge circuit is configured to discharge static electricity to the electrostatic discharge line when the display circuit of the display panel generates static electricity, and the display circuit is located in a display region of the display panel. An input terminal of the second electric discharge circuit is connected to an external signal input terminal of the display circuit, and the external signal input terminal is configured to input signals to the display circuit. An output terminal of the second electric discharge circuit is connected to the electrostatic discharge line, and the second electric discharge circuit discharges static electricity to the electrostatic discharge line when the external signal input terminal generates static electricity to prevent the static electricity generated on the external signal input terminal from entering the display circuit. An electrostatic protection device of an embodiment of the present invention can be applied to a display panel. Description will be made as follows.

With reference to FIG. 1, FIG. 1 is a schematic structural view of a display panel provided by an embodiment of the present invention.

In the present embodiment, the display panel 10 comprises a display circuit 13, an external signal input terminal 14, and an electrostatic protection device 12 that are connected to one another. The external signal input terminal 14 is configured to input signals to the display circuit 13. The electrostatic protection device 12 is configured to discharge static electricity generated on the display circuit 13 and the external signal input terminal 14 to the electrostatic discharge line 11. The display circuit 13 is located in a display region of the display panel 10.

In the present embodiment, electrostatic protection device 12 comprises a first electric discharge circuit 15 and a second electric discharge circuit 16. An input terminal of the first electric discharge circuit 15 is connected to the display circuit 13 of the display panel 10. An output terminal of the first electric discharge circuit 15 is connected to the electrostatic discharge line 11. The first electric discharge circuit 15 is configured to discharge static electricity to the electrostatic discharge line 11 when the display circuit 13 of the display panel 10 generates static electricity.

An input terminal of the second electric discharge circuit 16 is connected to the display circuit 13 of the external signal input terminal 14. An output terminal of the second electric discharge circuit 16 is connected to the electrostatic discharge line 11. The second electric discharge circuit 16 discharges static electricity to the electrostatic discharge line 11 when the external signal input terminal 14 generates static electricity to prevent static electricity generated on the external signal input terminal 14 from entering the display circuit 13.

The present invention discharges the static electricity in the display panel by the first electric discharge circuit and directly discharges the external static electricity by the second electric discharge circuit such that the static electricity in the display circuit can be discharged and prevent the external static electricity is prevented from entering the display circuit to avoid damage of the display panel.

Figure 2:
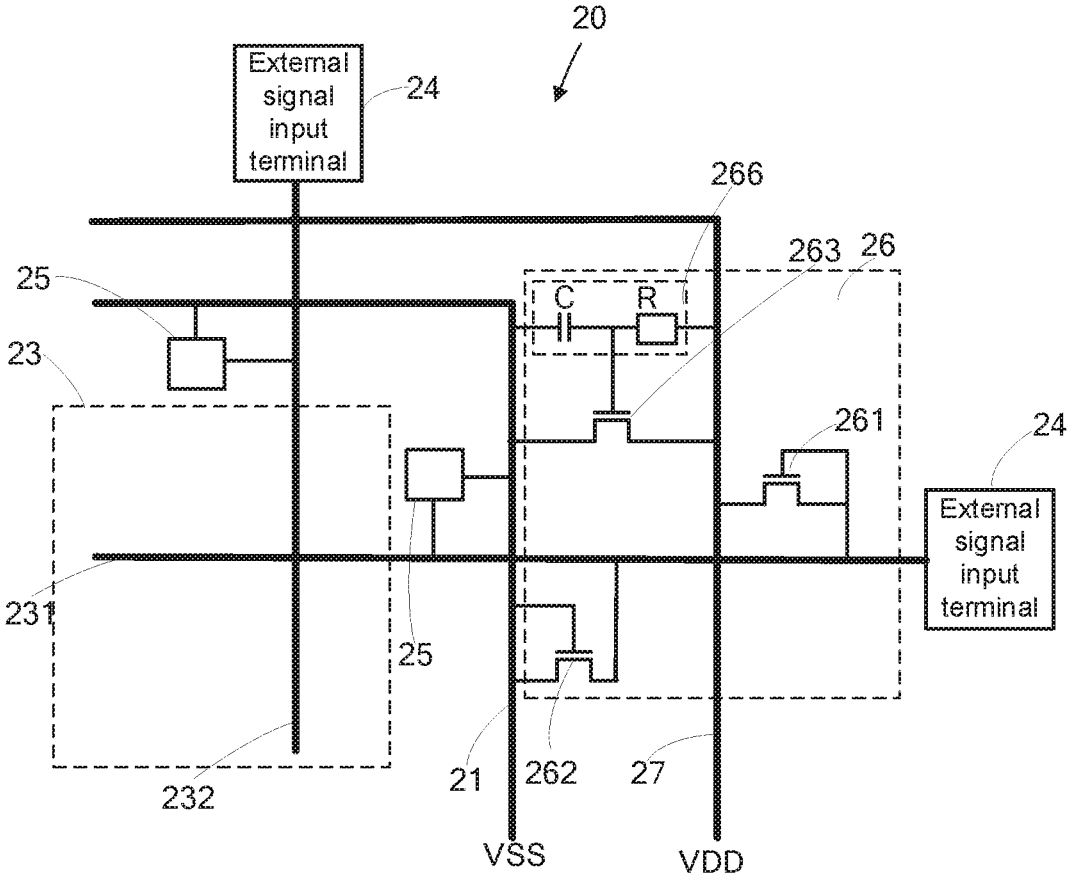
FIG. 2 is a schematic structural view of a display panel provided by another embodiment of the present invention.

To specifically described structures of the display panel and the electrostatic protection device of the present invention, FIG. 2 is referred to. FIG. 2 is a schematic structural view of a display panel provided by another embodiment of the present invention.

In the present embodiment, display panel 20 comprises a display circuit 23, an external signal input terminal 24, and an electrostatic protection device that are connected to one another. The external signal input terminal 24 is configured to input signals to the display circuit 23. The electrostatic protection device is configured to discharge static electricity generated on the display circuit 23 and the external signal input terminal 24 to the electrostatic discharge line 21. The display circuit 23 is located in a display region of the display panel 20.

In the present embodiment, the display circuit 23 comprises scan lines 231 laterally distributed and data lines 232 longitudinally distributed. An input terminal of the first electric discharge circuit 25 is connected to one of the scan lines 231 or one of the data lines 232 in the display circuit 23 to discharge static electricity generated on the scan line 231 or the data line 232. The external signal input terminal 24 is located on an end portion of the scan line 231 or the data line 232 to input scan signals or data signals to the scan line 231 or the data line 232. It should be noted that a first electric discharge circuit 25 can be disposed on each of the data lines 232 and the scan lines 231 in the display circuit 23, or a first electric discharge circuit 25 can be disposed on each of some of the data line 232 and the scan lines 231 of the display circuit 23, and the present invention has no limitation thereto.

In the present embodiment, the electrostatic discharge line 21 is connected to a reference voltage VSS, the reference voltage VSS can be set depending on specific circumstances to keep the electrostatic discharge line 21 in low a potential. Preferably, the reference voltage VSS is 0, in other words, the electrostatic discharge line 21 is grounded.

In the present embodiment, second electric discharge circuit 26 comprises a first transistor 261, a second transistor 262, a third transistor 263, and a voltage delay unit 266. Preferably, the first transistor 261 is an N-type transistor, the second transistor 262 is a P-type transistor, and the third transistor 263 is a P-type transistor. In other embodiment, types of the first transistor 261, the second transistor 262, and the third transistor 263 can be selected depending on specific circumstances, and the present invention has no limitation thereto.

In the present embodiment, a gate electrode and a drain electrode of the first transistor 261 are connected to the external signal input terminal 24. A source electrode of the first transistor 261 is connected to the electrostatic discharge line 21. The first transistor 261 is switched on when a voltage difference between the gate electrode of and the source electrode of the first transistor 261 exceeds a first predetermined threshold value to discharge positive charges on the external signal input terminal 24. A gate electrode and a drain electrode of the second transistor 262 is connected to the electrostatic discharge line 21, and a source electrode of the second transistor 262 is connected to the external signal input terminal 24. The second transistor 262 is switched on when a voltage difference between the gate electrode of the second transistor 262 and an output terminal of the second transistor 262 exceeds a second predetermined threshold value to discharge negative charges on the external signal input terminal 24.

Specifically, the source electrode of the first transistor 261, a first end of the voltage delay unit 266, and a source electrode of the third transistor 263 are connected. The first transistor 261 is connected to the electrostatic discharge line 21 by the voltage delay unit 266 and the third transistor 263 to be switched on when static electricity is generated such that the first transistor 261 discharges static electricity to the electrostatic discharge line 21 by the voltage delay unit 266 and the third transistor 263.

When the external signal input terminal 24 generates positive charges, the gate electrode and the drain electrode of the first transistor 261 are in high potentials, the source electrode of the first transistor 261 is in a low potential. The voltage difference between the gate electrode and the source electrode of the first transistor 261 exceeds the first predetermined threshold value, the first transistor 261 is switched on, static electricity is discharged to the source electrode of the first transistor 261. Further, static electricity is discharged to the electrostatic discharge line 21 by the voltage delay unit 266 and the third transistor 263. Of course, if the source electrode of the first transistor 261 is directly connected to the electrostatic discharge line 21, positive charges on the source electrode of the first transistor 261 will be discharged directly to the electrostatic discharge line 21.

When the external signal input terminal 24 generates negative charges, the source electrode of the second transistor 262 is in a low potential, and the gate electrode and the drain electrode of the second transistor 262 are in high potential. The voltage difference between the gate electrode and the source electrode of the first transistor 261 exceeds the second predetermined threshold value, the second transistor 262 is switched on, static electricity is discharged to the source electrode of the second transistor 262 and is further discharged to the electrostatic discharge line 21.

Furthermore, a gate electrode of the third transistor 263 is connected to a second end of the voltage delay unit 266, and a drain electrode of the third transistor 263 is connected to the electrostatic discharge line 21. A third end of the voltage delay unit 266 is connected to the electrostatic discharge line 21, the voltage delay unit 266 eases an increasing amount of voltage of the gate electrode of the third transistor 263 at the moment when the static electricity is generated to generate a voltage difference between the gate electrode and the source electrode of the third transistor 263 to switch on the third transistor 263 such that static electricity is discharged by the third transistor 263 to the electrostatic discharge line 21.

Specifically, the voltage delay unit 266 comprises a resistor R and a capacitor C that are sequentially connected to each other. An end of the resistor R, an end of the capacitor C, and the gate electrode of the third transistor 263 are connected. Another end of the resistor R is connected to the source electrode of the third transistor 263. Another end of the capacitor C is connected to the electrostatic discharge line 21. In other embodiment, can also ease third transistor 263 increasing amount of voltage of the gate electrode by a voltage delay unit 266 in other form, and the present invention has no limitation thereto.

When the external signal input terminal 24 generates positive charges, the source electrode of the first transistor 261 generates a high potential to further make both the first end of the voltage delay unit 266 and the source electrode of the third transistor 263 generate high potentials. However, because of existence of the voltage delay unit 266, a potential of the gate electrode of the third transistor 263 gradually increases such that the voltage difference is generated between the gate electrode and the source electrode of the third transistor 263, and the third transistor 263 is switched on. The drain electrode of the third transistor 263 is a reference voltage VSS. Positive charges on the source electrode of the third transistor 263 moves to the electrostatic discharge line 21 such that static electricity on the external signal input terminal 24 is discharged to the electrostatic discharge line 21.

Furthermore, the source electrode of the first transistor 261, the first end of the voltage delay unit 266, and the source electrode of the third transistor 263 are connected to a working voltage line 27. The working voltage line 27 outputs a working voltage when the display panel 20 operates to switch off the first transistor 261, the second transistor 262, and the third transistor 263. The working voltage is determined depending on a specific display panel 20, and the present invention has no limitation thereto. When the display panel 20 operates, the working voltage line 27 outputs a working voltage VDD. At the meantime, the external signal input terminal 24 also inputs a signal voltage. In other words, when the display panel 20 operates normally, the source electrode of the first transistor 261 is in a high potential, the gate electrode of the first transistor 261 is in a low potential, and the first transistor 261 is switched off. The gate electrode of the second transistor 262 is in a low potential, the source electrode is in a high potential, and the second transistor 262 is switched off. Both the gate electrode and the source electrode of the third transistor 263 are in high potentials, and the third transistor 263 is switched off. The first transistor 261, the second transistor 262, and the third transistor 263 switch off to prevent signal loss when the external signal input terminal 24 normally inputs signals, and to prevent voltage loss on the working voltage line 27 such that the display panel 20 is guaranteed to display normally.

In the present embodiment, first electric discharge circuit 25 is anyone of a resistor-type electric discharge circuit, floating-gate-type electric discharge circuit, and a diode-type electric discharge circuit, and the present invention has no limitation thereto.

Compared to the prior art, the present invention provides an electrostatic protection device and a display panel. The electrostatic protection device comprises a first electric discharge circuit and a second electric discharge circuit. An input terminal of the first electric discharge circuit is connected to a display circuit of the display panel. An output terminal of the first electric discharge circuit is connected to an electrostatic discharge line. The first electric discharge circuit is configured to discharge static electricity to the electrostatic discharge line when the display circuit of the display panel generates static electricity, and the display circuit is located in a display region of the display panel. An input terminal of the second electric discharge circuit is connected to an external signal input terminal of the display circuit, and the external signal input terminal is configured to input signals to the display circuit. An output terminal of the second electric discharge circuit is connected to the electrostatic discharge line, and the second electric discharge circuit discharges static electricity to the electrostatic discharge line when the external signal input terminal generates static electricity to prevent the static electricity generated on the external signal input terminal from entering the display circuit. The present invention, by the first electric discharge circuit discharging the static electricity in the display panel and by the second electric discharge circuit directly discharging external static electricity, discharges the static electricity in the display circuit and prevents the external static electricity from entering the display circuit and damaging the display panel.

Figure 3:
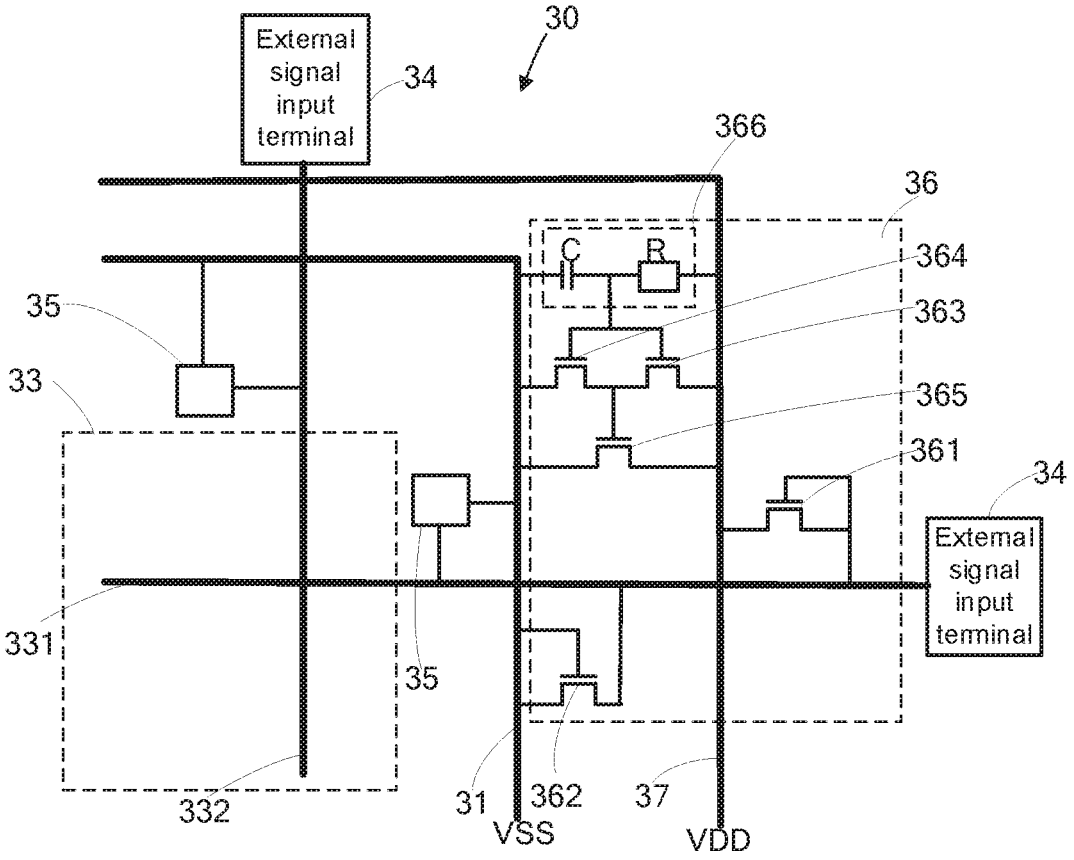
FIG. 3 is a schematic structural view of a display panel provided by still another embodiment of the present invention.

To better embody the display panel of an embodiment of the present invention, based on the above embodiment, an embodiment of the present invention provides still another embodiment of a display pane. With reference to FIG. 3, FIG. 3 is a schematic structural view of a display panel provided by still another embodiment of the present invention.

With reference to FIG. 3, in the present embodiment, a display panel 30 comprises a display circuit 33, an external signal input terminal 34, a first electric discharge circuit 35, a second electric discharge circuit 36, an electrostatic discharge line 31, and a working voltage line 37. The display circuit 33 comprises scan lines 331 and data lines 332. The second electric discharge circuit 36 comprises a first transistor 361, a second transistor 362, a third transistor 363, and a voltage delay unit 366. The display circuit 33 in the present embodiment, the external signal input terminal 34, the first electric discharge circuit 35, the electrostatic discharge line 31, the working voltage line 37, the scan lines 331, the data lines 332, the first transistor 361, the second transistor 362, the third transistor 363, and the voltage delay unit 366 are the same as the display circuit 23, the external signal input terminal 24, the first electric discharge circuit 25, the electrostatic discharge line 21, the working voltage line 27, the scan lines 231, the data lines 232, the first transistor 261, the second transistor 262, the third transistor 263, and the voltage delay unit 266 in the above embodiment, and will not be described repeatedly herein. The following description will aim at a difference of the present embodiment from the above embodiment.

In the present embodiment, second electric discharge circuit 36 further comprises a fourth transistor 364 and a fifth transistor 365. Preferably, the fourth transistor 364 is an N-type transistor, the fifth transistor 365 is an N-type transistor. A gate electrode of the fourth transistor 364 is connected to a second end of a voltage delay unit 366. A source electrode of the fourth transistor 364 is connected to the electrostatic discharge line 31. The drain electrode of the third transistor 363 is connected to a drain electrode fourth transistor 364 to be connected to the electrostatic discharge line 31 through the fourth transistor 364. A gate electrode of the fifth transistor 365 is connected to the drain electrode of the third transistor 363. A source electrode of the fifth transistor 365 is connected to the electrostatic discharge line 31. A drain electrode of the fifth transistor 365 is connected to the source electrode of the third transistor 363. The fifth transistor 365 is switched on when the third transistor 363 is switched on to further discharge static electricity to the electrostatic discharge line 31.

When the external signal input terminal 34 generates positive charges, the source electrode of the third transistor 363 generate a high potential such that a first end of the voltage delay unit 366, the source electrode of the third transistor 363, and the source electrode of the fifth transistor 365 generate high potentials. However, because of existence of the voltage delay unit 366, a voltage difference is generated between the gate electrode and the source electrode of the third transistor 363, and the third transistor 363 is switched on. After the third transistor 363 is switched on, both the drain electrode of the fourth transistor 364 and the gate electrode of the fifth transistor 365 are in high potentials, and the source electrode of the fourth transistor 364 is in a low potential. The gate electrode of the fourth transistor 364 is in a high potential, the fourth transistor 364 is switched on, positive charges is discharged to the electrostatic discharge line 31 through the third transistor 363 and the fourth transistor 364. At the meantime, because the source electrode of the fifth transistor 365 is in a low potential, the fifth transistor 365 is switched on, the positive charges is discharged to the electrostatic discharge line 31 through the fifth transistor 365. Therefore, when the external signal input terminal 34 generates the positive charges, the positive charges can be discharged to the electrostatic discharge line 31 through the third transistor 363 and the fourth transistor 364, and can also be discharged the electrostatic discharge line 31 to through the fifth transistor 365, which increases discharge efficiency and further prevents static electricity in the external signal input terminal 34 from entering the display circuit 33.

When the display panel operates normally, the first transistor 361, the second transistor 362, and the third transistor 363 are all switched off. The gate electrode and the source electrode of the fifth transistor 365 are in low potentials, the fifth transistor 365 is also switched off, which can prevent signal loss when the external signal input terminal 34 normally inputs signals, and can also prevent voltage loss on the working voltage line such that normal displaying of the display panel 30 is guaranteed.

Compared to the prior art, the present invention provides an electrostatic protection device and a display panel. The electrostatic protection device comprises a first electric discharge circuit and a second electric discharge circuit. An input terminal of the first electric discharge circuit is connected to a display circuit of the display panel. An output terminal of the first electric discharge circuit is connected to an electrostatic discharge line. The first electric discharge circuit is configured to discharge static electricity to the electrostatic discharge line when the display circuit of the display panel generates static electricity, and the display circuit is located in a display region of the display panel. An input terminal of the second electric discharge circuit is connected to an external signal input terminal of the display circuit, and the external signal input terminal is configured to input signals to the display circuit. An output terminal of the second electric discharge circuit is connected to the electrostatic discharge line, and the second electric discharge circuit discharges static electricity to the electrostatic discharge line when the external signal input terminal generates static electricity to prevent the static electricity generated on the external signal input terminal from entering the display circuit. The present invention, by the first electric discharge circuit discharging the static electricity in the display panel and by the second electric discharge circuit directly discharging external static electricity, discharges the static electricity in the display circuit and prevents the external static electricity from entering the display circuit and damaging the display panel.

It should be noted that only the above structures are described in the above display panel embodiment. It should be understood that besides the above structures, the display panel of an embodiment of the present invention can further comprise other necessary structures according to demands, for example a substrate, a buffer layer, interlayer dielectric (ILD), etc., and no limitation is thereto.

In the specific implementation, each of the above units or structures may be implemented as a separate entity, or may be any combination, and implemented as the same entity or a plurality of entities. The specific implementation of the above units or structures refer to the previous method embodiment and will not be described repeatedly.

An electrostatic protection device and a display panel provided by an embodiment of the present invention has been described as above. In the specification, the specific examples are used to explain the principle and embodiment of the present invention. The above description of the embodiments is only used to help understand the method of the present invention and its spiritual idea. Meanwhile, for those skilled in the art, according to the present the idea of invention, changes will be made in specific embodiment and application. In summary, the contents of this specification should not be construed as limiting the present invention.

What is claimed is:

1. An electrostatic protection device, wherein the electrostatic protection device comprises a first electric discharge circuit and a second electric discharge circuit;

an input terminal of the first electric discharge circuit is connected to a display circuit of a display panel, an output terminal of the first electric discharge circuit is connected to an electrostatic discharge line, the first electric discharge circuit is configured to discharge static electricity to the electrostatic discharge line when the display circuit of the display panel generates static electricity, wherein the display circuit is located in a display region of the display panel;

the first electric discharge circuit is one of a resistor-type electric discharge circuit, a floating-gate-type electric discharge circuit, and a diode-type electric discharge circuit, the input terminal of the first electric discharge circuit is connected to a scan line or a data line in the display circuit to discharge static electricity generated from the scan line or the data line, an external signal input terminal is located on an end portion of the scan line or the data line to input a scan signal or a data signal into the scan line or the data line; and an input terminal of the second electric discharge circuit is connected to the external signal input terminal of the display circuit, the external signal input terminal is configured to input a signal into the display circuit, an output terminal of the second electric discharge circuit is connected to the electrostatic discharge line, the second electric discharge circuit discharges static electricity into the electrostatic discharge line when the external signal input terminal generates static electricity to prevent static electricity generated on the external signal input terminal from entering the display circuit.

2. The electrostatic protection device as claimed in claim 1, wherein the second electric discharge circuit comprises a first transistor and a second transistor, a gate electrode and a drain electrode of the first transistor are connected to the external signal input terminal, a source electrode of the first transistor is connected to the electrostatic discharge line, the first transistor is switched on when a voltage difference between the gate electrode of the first transistor and the source electrode of the first transistor exceeds a first predetermined threshold value to discharge to discharge positive charges on the external signal input terminal; and a gate electrode and a drain electrode of the second transistor are connected to the electrostatic discharge line, a source electrode of the second transistor is connected to the external signal input terminal, the second transistor is switched on when a voltage difference between the gate electrode of the second transistor and an output terminal of the second transistor exceeds a second predetermined threshold value to discharge negative charges on the external signal input terminal.

3. The electrostatic protection device as claimed in claim 2, wherein the second electric discharge circuit further comprises a voltage delay unit and a third transistor;

the source electrode of the first transistor, a first end of the voltage delay unit, and a source electrode of the third transistor are connected, the first transistor is connected to the electrostatic discharge line by the voltage delay unit and the third transistor and is further switched on when static electricity is generated to discharge static electricity to the electrostatic discharge line by the voltage delay unit and the third transistor;

a gate electrode of the third transistor is connected to a second end of the voltage delay unit, a drain electrode of the third transistor is connected to the electrostatic discharge line; and a third end of the voltage delay unit is connected to the electrostatic discharge line, the voltage delay unit eases an increasing amount of voltage of the gate electrode of the third transistor at a moment when static electricity is generated to generate a voltage difference between the gate electrode and the source electrode of the third transistor such that the third transistor is switched on and the third transistor discharges the static electricity to the electrostatic discharge line.

4. The electrostatic protection device as claimed in claim 3, wherein the voltage delay unit comprises a resistor and a capacitor that are sequentially connected to the voltage delay unit, an end of the resistor, an end of the capacitor, and the gate electrode of the third transistor are connected, another end of the resistor is connected to the source electrode of the third transistor, and another end of the capacitor is connected to the electrostatic discharge line.

5. The electrostatic protection device as claimed in claim 3, wherein the source electrode of the first transistor, the first end of the voltage delay unit, and the source electrode of the third transistor are connected to a working voltage line, the working voltage line outputs a working voltage when the display panel operates to switch off the first transistor and the third transistor.

6. The electrostatic protection device as claimed in claim 3, wherein the second electric discharge circuit further comprises a fourth transistor and a fifth transistor;

a gate electrode of the fourth transistor is connected to the second end of the voltage delay unit, a source electrode of the fourth transistor is connected to the electrostatic discharge line, the drain electrode of the third transistor is connected to a drain electrode of the fourth transistor to be connected to the electrostatic discharge line through the fourth transistor; and a gate electrode of the fifth transistor is connected to the drain electrode of the third transistor, a source electrode of the fifth transistor is connected to the electrostatic discharge line, a drain electrode of the fifth transistor is connected to the source electrode of the third transistor, the fifth transistor is switched on when the third transistor is switched on to discharge the static electricity to the electrostatic discharge line.

7. The electrostatic protection device as claimed in claim 6, wherein the first transistor is an N-type transistor, the second transistor is a P-type transistor, the third transistor is a P-type transistor, the fourth transistor is an N-type transistor, and the fifth transistor is an N-type transistor.

8. An electrostatic protection device, wherein the electrostatic protection device comprises a first electric discharge circuit and a second electric discharge circuit;

the input terminal of the first electric discharge circuit is connected to the display circuit of the display panel, the output terminal of the first electric discharge circuit is connected to the electrostatic discharge line, the first electric discharge circuit is configured to discharge static electricity to the electrostatic discharge line when the display circuit of the display panel generates static electricity, wherein the display circuit is located in the display region of the display panel; and the input terminal of the second electric discharge circuit is connected to the external signal input terminal of the display circuit, the external signal input terminal is configured to input a signal into the display circuit, the output terminal of the second electric discharge circuit is connected to the electrostatic discharge line, the second electric discharge circuit discharge static electricity to the electrostatic discharge line when the external signal input terminal generates static electricity to prevent the static electricity generated on the external signal input terminal from entering the display circuit.

9. The electrostatic protection device as claimed in claim 8, wherein the second electric discharge circuit comprises a first transistor and a second transistor, a gate electrode and a drain electrode of the first transistor are connected to the external signal input terminal, a source electrode of the first transistor is connected to the electrostatic discharge line, the first transistor is switched on when a voltage difference between the gate electrode of the first transistor and the source electrode of the first transistor exceeds a first predetermined threshold value to discharge to discharge positive charges on the external signal input terminal; and a gate electrode and a drain electrode of the second transistor are connected to the electrostatic discharge line, a source electrode of the second transistor is connected to the external signal input terminal, the second transistor is switched on when a voltage difference between the gate electrode of the second transistor and an output terminal of the second transistor exceeds a second predetermined threshold value to discharge negative charges on the external signal input terminal.

10. The electrostatic protection device as claimed in claim 9, wherein the second electric discharge circuit further comprises a voltage delay unit and a third transistor;

the source electrode of the first transistor, a first end of the voltage delay unit, and a source electrode of the third transistor are connected, the first transistor is connected to the electrostatic discharge line by the voltage delay unit and the third transistor and is further switched on when static electricity is generated to discharge static electricity to the electrostatic discharge line by the voltage delay unit and the third transistor;

a gate electrode of the third transistor is connected to a second end of the voltage delay unit, a drain electrode of the third transistor is connected to the electrostatic discharge line; and a third end of the voltage delay unit is connected to the electrostatic discharge line, the voltage delay unit eases an increasing amount of voltage of the gate electrode of the third transistor at a moment when static electricity is generated to generate a voltage difference between the gate electrode and the source electrode of the third transistor such that the third transistor is switched on and the third transistor discharges the static electricity to the electrostatic discharge line.

11. The electrostatic protection device as claimed in claim 10, wherein the voltage delay unit comprises a resistor and a capacitor that are sequentially connected to the voltage delay unit, an end of the resistor, an end of the capacitor, and the gate electrode of the third transistor are connected, another end of the resistor is connected to the source electrode of the third transistor, and another end of the capacitor is connected to the electrostatic discharge line.

12. The electrostatic protection device as claimed in claim 10, wherein the source electrode of the first transistor, the first end of the voltage delay unit, and the source electrode of the third transistor are connected to a working voltage line, the working voltage line outputs a working voltage when the display panel operates to switch off the first transistor and the third transistor.

13. The electrostatic protection device as claimed in claim 10, wherein the second electric discharge circuit further comprises a fourth transistor and a fifth transistor;

a gate electrode of the fourth transistor is connected to the second end of the voltage delay unit, a source electrode of the fourth transistor is connected to the electrostatic discharge line, the drain electrode of the third transistor is connected to a drain electrode of the fourth transistor to be connected to the electrostatic discharge line through the fourth transistor; and a gate electrode of the fifth transistor is connected to the drain electrode of the third transistor, a source electrode of the fifth transistor is connected to the electrostatic discharge line, a drain electrode of the fifth transistor is connected to the source electrode of the third transistor, the fifth transistor is switched on when the third transistor is switched on to discharge the static electricity to the electrostatic discharge line.

14. The electrostatic protection device as claimed in claim 13, wherein the first transistor is an N-type transistor, the second transistor is a P-type transistor, the third transistor is a P-type transistor, the fourth transistor is an N-type transistor, and the fifth transistor is an N-type transistor.

15. The electrostatic protection device as claimed in claim 8, wherein the first electric discharge circuit is one of a resistor-type electric discharge circuit, a floating-gate-type electric discharge circuit, and a diode-type electric discharge circuit.

16. The electrostatic protection device as claimed in claim 8, wherein the input terminal of the first electric discharge circuit is connected to a scan line or a data line in the display circuit to discharge static electricity generated from the scan line or the data line, an external signal input terminal is located on an end portion of the scan line or the data line to input a scan signal or a data signal into the scan line or the data line.

17. A display panel, wherein the display panel comprises an electrostatic protection device, the electrostatic protection device comprises a first electric discharge circuit and a second electric discharge circuit;

the input terminal of the first electric discharge circuit is connected to the display circuit of the display panel, the output terminal of the first electric discharge circuit is connected to the electrostatic discharge line, the first electric discharge circuit is configured to discharge static electricity to the electrostatic discharge line when the display circuit of the display panel generates static electricity, wherein the display circuit is located in the display region of the display panel; and the input terminal of the second electric discharge circuit is connected to the external signal input terminal of the display circuit, the external signal input terminal is configured to input a signal into the display circuit, the output terminal of the second electric discharge circuit is connected to the electrostatic discharge line, the second electric discharge circuit discharge static electricity to the electrostatic discharge line when the external signal input terminal generates static electricity to prevent the static electricity generated on the external signal input terminal from entering the display circuit.

18. The display panel as claimed in claim 17, wherein the second electric discharge circuit comprises a first transistor and a second transistor, a gate electrode and a drain electrode of the first transistor are connected to the external signal input terminal, a source electrode of the first transistor is connected to the electrostatic discharge line, the first transistor is switched on when a voltage difference between the gate electrode of the first transistor and the source electrode of the first transistor exceeds a first predetermined threshold value to discharge to discharge positive charges on the external signal input terminal; and a gate electrode and a drain electrode of the second transistor are connected to the electrostatic discharge line, a source electrode of the second transistor is connected to the external signal input terminal, the second transistor is switched on when a voltage difference between the gate electrode of the second transistor and an output terminal of the second transistor exceeds a second predetermined threshold value to discharge negative charges on the external signal input terminal.

19. The display panel as claimed in claim 18, wherein the second electric discharge circuit further comprises a voltage delay unit and a third transistor;

the source electrode of the first transistor, a first end of the voltage delay unit, and a source electrode of the third transistor are connected, the first transistor is connected to the electrostatic discharge line by the voltage delay unit and the third transistor and is further switched on when static electricity is generated to discharge static electricity to the electrostatic discharge line by the voltage delay unit and the third transistor;

a gate electrode of the third transistor is connected to a second end of the voltage delay unit, a drain electrode of the third transistor is connected to the electrostatic discharge line; and a third end of the voltage delay unit is connected to the electrostatic discharge line, the voltage delay unit eases an increasing amount of voltage of the gate electrode of the third transistor at a moment when static electricity is generated to generate a voltage difference between the gate electrode and the source electrode of the third transistor such that the third transistor is switched on and the third transistor discharges the static electricity to the electrostatic discharge line.

20. The display panel as claimed in claim 19, wherein the voltage delay unit comprises a resistor and a capacitor that are sequentially connected to the voltage delay unit, an end of the resistor, an end of the capacitor, and the gate electrode of the third transistor are connected, another end of the resistor is connected to the source electrode of the third transistor, and another end of the capacitor is connected to the electrostatic discharge line.

* * * * *